United States Patent [19]

Iwao et al.

[11] 4,157,294

[45] Jun. 5, 1979

[54] METHOD OF PREPARING BASE STOCKS FOR LUBRICATING OIL

[75] Inventors: Yozo Iwao, Sodegaura; Susumu Yamamoto, Yokohama; Takatoshi Kunihiro, Sodeguara, all of Japan

[73] Assignee: Idemitsu Kosan Company Limited, Tokyo, Japan

[21] Appl. No.: 907,774

[22] Filed: May 19, 1978

Related U.S. Application Data

[63] Continuation of Ser. No. 738,325, Nov. 2, 1976, abandoned.

[51] Int. Cl.[2] ..... C10G 23/00; C10G 34/00

[52] U.S. Cl. ..... 208/264; 208/18; 208/19

[58] Field of Search ..... 208/14, 19, 264, 18

[56] References Cited

U.S. PATENT DOCUMENTS

| | | | |
|---|---|---|---|
| 3,093,576 | 6/1963 | Campbell | 208/19 |
| 3,303,125 | 2/1967 | Marter et al. | 208/19 |

*Primary Examiner*—Herbert Levine

*Attorney, Agent, or Firm*—Flynn & Frishauf

[57] ABSTRACT

Base stocks for lubricating oil with excellent thermal stability are produced by hydrofinishing a mixture consisting of 10 to 60 percent by volume of a neutralized extract and 90 to 40 percent by volume of an unextracted intermediate distillate product of low total acid value, in which the neutralized extract is prepared by alkaline treating and vacuum distillation of a extract obtained by solvent extraction of said intermediate distillate product by a solvent having affinity for aromatic compounds.

7 Claims, No Drawings

METHOD OF PREPARING BASE STOCKS FOR LUBRICATING OIL

This is a continuation of application Ser. No. 738,325, filed Nov. 2, 1976 now abandoned.

FIELD OF THE INVENTION

This invention relates to a method of preparing base stocks for lubricating oil with excellent thermal stability. More particularly, it relates to a method of preparing base stocks for lubricating oil with excellent thermal stability and sunlight stability by maximum utilization of an intermediate product and the neutralized extract.

BACKGROUND OF THE INVENTION

As a method of preparing base stocks for lubricating oil, it has been known to refine an intermediate product by comparatively mild hydrogenation, so-called hydrofinishing. However, base stocks for lubricating oil with excellent thermal stability can not be obtained by this process. Thus in order to overcome the above defect, as a modified process it has been proposed that hydrofinishing is carried out after extraction of an intermediate product with such a solvent as furfural, phenol, etc., as described in Oil and Gas Journal, Vol. 53, No. 26, p.81–84 (1954). However, according to this process, 20–30 percent of charge stocks are removed as the extract by solvent extraction and thus the product yield is decreased. On the other hand, it has been proposed to obtain base stocks for lubricating oil with excellent thermal stability by only an extraction process. However, according to this process, it is essential to remove undesirable components extensively for thermal stability and thus substantial amounts of desirable materials are moved to the extract. Therefore, further reduction of the raffinate yield, i.e. the product yield, can not be avoided. These extracts are used as a heavy oil and useful components as a lubricating oil are not used effectively.

SUMMARY OF THE INVENTION

An object of the present invention is to provide a method of preparing base stocks for lubricating oil with thermal stability by maximum utilization of an intermediate product. More particularly, it relates to provide a method of preparing base stocks for lubricating oil with excellent thermal stability and sunlight stability by utilization of extracts.

DESCRIPTION OF THE PREFERRED EMBODIMENTS

A method of the present invention comprises subjecting to hydrofinishing a mixture consisting of 10–60 percent by volume of a neutralized extract prepared by alkaline treating vacuum distillation of an extract obtained through extraction of an intermediate product by a solvent having affinity for aromatic compounds and 90–40 percent by volume of an intermediate product of low total acid value.

An intermediate product in the present invention is a distillate obtained through a vacuum distillation of a topped crude oil which is prepared by removing a light fraction of a crude oil by distillation or a deasphalted oil obtained by deasphalting a residual oil after a vacuum distillation and, if necessary, dewaxing. An intermediate product which is extracted with a solvent may be the same or different from a raw oil for an intermediate product which has a low total acid value. That is, the latter is an oil having a total acid value of lower than 2.0, preferably lower than 0.5, and is (1) an intermediate product having a low total acid value of lower than 2.0, preferably lower than 0.5 or (2) a distillate obtained by alkaline treating vacuum distillation of an intermediate product when the total acid value of said oil is higher than 2.0, or (3) a distillate obtained by alkaline treating vacuum distillation of a topped crude oil. An intermediate product having total acid value of more than 2.0 is not preferred because it causes short catalyst life and undesirable influence on the material of the device. The process of alkaline treating vacuum distillation in the case of (2) and (3) can be carried out in a mixture with prescribed amounts of extracts.

In the present invention, known solvents such as phenol, furfural, dichloroethyl ether, N-methyl-2-pyrolidone, etc. can be used as solvents having affinity for aromatic compounds and a process of extraction can be operated according to conventional methods. The process is carried out normally by countercurrent contact method and components for lubricating oil are obtained from the top of the tower as a raffinate and undesirable components as lubricating oil are removed from the bottom of the tower as an extract and then solvent is recovered with distillation.

To the extract thus obtained, an alkali such as sodium hydroxide, potassium hydroxide etc. is added and then the extract is refined by alkaline treating vacuum distillation. Amounts of alkali added are enough to neutralize petroleum acids (such as naphthenic acids) in the extract.

Thereafter, 10–60 percent by volume of a neutralized extract and 90–40 percent by volume of an intermediate product of low total acid value mentioned above are mixed and the resulting mixture is refined with hydrofinishing. When amounts of the neutralized extract are less than 10 percent by volume, thermal stability of base stocks for lubricating oil obtained by hydrofinishing is insufficient. On the other hand, when amounts of neutralized extract are more than 60 percent by volume, base stocks for lubricating oil obtained do not form precipitates by the thermal stability test (JIS-K-2540), but the increase of total acid value is extensive and thermal stability is practically unsatisfactory.

Hydrofinishing of the mixture can be carried out by conventional methods. Normally, the hydrofinishing is performed using a catalyst which is prepared by holding one or more than two kinds of metals having hydrogenation activity selected from metals belonging to group VIII of the Periodic Table such as Fe, Co, Ni, etc. and metals belonging to group VI of the Periodic Table such as Mo, W, etc. or their oxides or sulfides on alumina, silica-alumina, zeolite, etc. and performed at a temperature of 250°–400° C., a pressure of 50–150 $kg/cm^2$, a LHSV of 0.5–3.0 per hour, and $H_2$/oil; 10–300 $Nm^3/kl$.

Base stocks for lubricating oils obtained by the present invention are excellent in thermal stability and sunlight stability and thus can be used preferably for preparation of a lubricating oil. The present invention provides not only base stocks for lubricating oils with excellent thermal stability but also a method of effective utilization of extracts. Therefore, maximum utilization of an intermediate product can be attained according to the present invention.

The present invention is described in detail by means of the following examples.

EXAMPLE 1

An extract was obtained by extracting an intermediate product (boiling point: 335°–435° C., viscosity 5.38 cst at 98.9° C.) prepared by distillation under the reduced pressure of a topped crude oil (naphthene base) of Klamono with furfural under the conditions of the ratio of solvent:an intermediate product=3:1 and a temperature of 120° C. Extract yield was 50 percent. Total acid value of the extract was 8.4 (measured by JIS-K-2501 or 2502).

To this extract a neutralization equivalent of sodium hydroxide solution was added and stirred, and after heating and dehydration simple vacuum distillation was performed and the neutralized extract was obtained as the distillate. The residue in the still was about 10 percent. Characteristics of the neutralized extract are shown in Table 1.

Table 1

| | |
|---|---|
| Color | Dark Green |
| Specific gravity (15/4° C.) | 1.007 |
| Viscosity (98.9° C.) | 6.45 cst |
| Total acid value (milli gram KOH/gram) | 0.32 |
| Sulfur (weight percent) | 1.71 |

A dewaxed distillate was obtained by solvent dewaxing a distillate (boiling point 430°–485° C.) prepared by vacuum distillation of a topped crude oil (naphthene oil) of Kuwait under the conditions of the ratio of solvent (methyl ethyl ketone:toluene=1:1) to the intermediate product=3:1 and a filtration temperature of −20° C.

The dewaxed distillate and the neutralized extract were mixed at the prescribed combination and the resulting mixture was refined with hydrofinishing a using Co—Mo—$Al_2O_3$ catalyst (CoO 3.0 weight percent and $MoO_3$ 2.0 weight percent) and under the conditions of a temperature of 320° C., a pressure of 100 kg/cm$^2$, a LHSV of 1.0 per hour and $H_2$/ oil 100 Nm$^3$/kl. Characteristics of base stocks for lubricating oil thus obtained were measured and results are shown in Table 2.

Table 2

| | Amounts of neutralized extract added to dewaxed distillate (volume percent) | | | | | |
|---|---|---|---|---|---|---|
| | 0 | 5 | 10 | 40 | 60 | 80 |
| Before hydrofinishing | | | | | | |
| Color[1)] | L 3.5 | L 4.5 | L 7.5 | above 8 | above 8 | above 8 |
| Specific gravity[2)] | 0.923 | 0.927 | 0.931 | 0.957 | 0.973 | 0.990 |
| Viscosity[3)] | 6.57 | 6.56 | 6.54 | 6.51 | 6.49 | 6.47 |
| Total acid value[4)] | 0.03 | 0.04 | 0.07 | 0.16 | 0.22 | 0.26 |
| Sulfur[5)] | 2.84 | 2.78 | 2.70 | 2.39 | 2.16 | 1.95 |
| Pour point[6)] | −7.5 | — | — | — | — | — |
| Thermal stability[7)] | Fail | Fail | Fail | Fail | Fail | Fail |
| Increase in total acid value[8)] | 0.75 | 0.67 | 0.48 | 0.51 | 0.49 | 0.57 |
| D-1500[9)] | 6.5 | 8< | 8< | 8< | 8< | 8< |
| Appearance[10)] | sludge | sludge | good | good | good | good |
| After hydrofinishing | | | | | | |
| Color | L 2.0 | L 2.0 | L 2.0 | L 2.0 | L 2.0 | L 3.0 |
| Specific gravity | 0.917 | 0.921 | 0.924 | 0.950 | 0.966 | 0.983 |
| Viscosity | 5.91 | 6.02 | 5.89 | 5.97 | 5.87 | 5.93 |
| Total acid value | 0.01 | 0.01 | 0.01 | 0.01 | 0.01 | 0.01 |
| Sulfur | 1.71 | 1.69 | 1.66 | 1.46 | 1.34 | 1.23 |
| Thermal stability | Fail | Fail | Pass | Pass | Pass | Pass |
| Increase in total acid value | 0.47 | 0.36 | 0.12 | 0.09 | 0.15 | 0.32 |
| D-1500 | 6.0 | 4.5 | 4.5 | 4.5 | <5.0 | 5.0 |
| Appearance | sludge | dull | good | good | good | good |

Notes
1) according to ASTM-D 1500
2) according to JIS-K-2249(15/4° C.)
3) according to JIS-K-2283(98.9° C. cst)
4) according to JIS-K-2501 or K-2502 (milli gram KOH per gram)
5) according to JIS-K-2263 (percent by weight)
6) according to JIS-K-2269(° C.)
7) according to JIS-K-2540(170° C. 12 hours)
8) samples tested in (7) was examined further by the method of (4) in order to obtain amounts changed. (milli gram KOH per gram)
9) according to Gulf Method 925; Color was tested by ASTM D-1500 after exposure for 10 days
10) Appearance after exposure for 10 days

EXAMPLE 2

Topped crude oil (naphthene base) of Tia Juana was subjected to a vacuum distillation and was separated into a first distillate (boiling point: 290°–340° C.), a second distillate (boiling point: 340°–420° C.) and a third distillate (boiling point: 420°–470° C.). These three distillates were solvent extracted with furfural, respectively. The yield and characteristics of the extract are shown in Table 3.

Table 3

| | Extract from 1st distillate | Extract from 2nd distillate | Extract from 3rd distillate |
|---|---|---|---|
| Extract yield | 20 | 25 | 50 |
| Color | Dark Green | Dark Green | Dark Green |
| Specific gravity | 0.991 | 1.010 | 1.008 |
| Viscosity | 2.90 | 7.86 | 13.6 |
| Total acid value | 18.3 | 16.7 | 14.0 |
| Sulfur | 3.35 | 3.50 | 3.24 |

These three extracts were mixed and then the resulting mixture was added to a topped crude oil of Tia Juana at 30 percent by volume. Characteristics of the topped crude oil are shown in Table 4.

Table 4

| | | | |
|---|---|---|---|
| Specific gravity | 0.9574 | Total acid value | 7.4 |
| Viscosity | 12.9 | Sulfur | 2.3 |
| Flash point* | 132 | Pour point | −20 |

*according to JIS-K-2274

To the mixture of extracts and the topped crude oil, the neutralization equivalent of sodium hydroxide was added and then alkaline treating vacuum distillation was performed to obtain three distillates, i.e. the first distillate (boiling point: 300°-335° C.), the second distillate (boiling point: 335°-415° C.) and the third distillate (boiling point: 415°-440° C.).

Subsequently, these raw distillates were finished by hydrofinishing using a Co—Mo—Fe—$Al_2O_3$ catalyst (CoO 3.5 weight percent, $MoO_3$ 10.5 weight percent, and $Fe_2O_3$ 14.0 weight percent) under the conditions of a pressure of 80 kg/cm$^2$, a temperature of 270° C., a LHSV of 1.0 per hour and $H_2$/ oil of 60 Nm$^3$/kl, respectively. The base stocks for lubricating oil thus obtained had characteristics as shown in Table 5.

For the purpose of comparative study, three distillates obtained by alkaline treating vacuum distillation the above mentioned topped crude oil of Tia Juana with the same conditions as those above without preparing a mixture of extracts were subjected to hydrofinishing with the same condition as above. Characteristics of this product are shown in Table 5.

Table 5

| | Comparative Example | | | Example | | |
|---|---|---|---|---|---|---|
| | 1st distillate | 2nd distillate | 3rd distillate | 1st distillate | 2nd distillate | 3rd distillate |
| Before hydrofinishing | | | | | | |
| Color | 1.5 | L 2.5 | L 4.5 | 1.5 | L 3.5 | L 6.5 |
| Specific gravity | 0.910 | 0.944 | 0.954 | 0.924 | 0.958 | 0.974 |
| Viscosity | 2.18 | 5.76 | 12.8 | 2.17 | 5.28 | 12.6 |
| Total acid value | 0.06 | 0.11 | 0.34 | 0.06 | 0.17 | 0.41 |
| Sulfur | 1.54 | 2.23 | 2.12 | 1.85 | 2.77 | 2.89 |
| Thermal stability | Fail* | Fail | Fail | Fail | Fail | Fail |
| Increase in total acid value | 0.21 | 0.33 | 0.29 | 0.17 | 0.42 | 0.39 |
| D-1500 | <4.5 | <5.5 | 7.0 | 3.0 | <5.5 | 7.5 |
| Appearance | sludge | good | good | good | good | good |
| After hydrofinishing | | | | | | |
| Color | L 0.5 | L 1.0 | L 2.5 | L 0.5 | L 1.0 | L 2.5 |
| Specific gravity | 0.909 | 0.943 | 0.952 | 0.923 | 0.957 | 0.971 |
| Viscosity | 2.16 | 5.69 | 12.7 | 2.17 | 5.19 | 11.8 |
| Total acid value | 0.01 | 0.01 | 0.01 | 0.01 | 0.01 | 0.01 |
| Sulfur | 1.43 | 2.15 | 1.94 | 1.72 | 2.71 | 2.76 |
| Thermal stability | Fail | Fail | Fail | Pass | Pass | Pass |
| Increase in total acid value | 0.15 | 0.28 | 0.22 | 0.05 | 0.09 | 0.10 |
| D-1500 | <2.5 | 2.5 | 3.5 | 2.0 | <2.5 | <3.5 |
| Appearance | dull | good | good | good | good | good |

Measuring Conditions were same as described in Example 1.
*tested at a temperature of 150° C. for 12 hours

What is claimed is:

1. A method for preparing a base stock for lubricating oil having excellent thermal and sunlight stability, consisting essentially of the steps of:
   (1) vacuum distilling a topped crude oil and collecting a distillate (i) thereof,
   (2) extracting said distillate (i) with a solvent having an affinity for aromatic hydrocarbons to obtain a raffinate and a solvent extract, said solvent extract having a total acid value of more than about 8,
   (3) neutralizing said extract with an alkali to form a neutralized extract having a total acid value of less than 2.0,
   (4) forming a mixture of from 10 to 60 percent of said neutralized extract and from 90 to 40 percent of a distillate (ii) of a topped crude oil, said distillate (ii) having a total acid value of less than 2.0, and
   (5) hydrofinishing said mixture formed in (4).

2. A method according to claim 1, wherein said solvent is a solvent selected from the group consisting of phenol, furfural, dichlorethyl ether and N-methyl-2-pyrrolidone.

3. The method of claim 1, wherein said distillate (ii) is dewaxed before being so mixed in (4).

4. The method of claim 1, wherein said distillate (ii) has a total acid value of less than 0.5.

5. A method for preparing a base stock for lubricating oil having excellent thermal and sunlight stability, consisting essentially of the steps of:
   (1) vacuum distilling a topped crude oil and collecting a distillate (i) thereof,
   (2) extracting said distillate (i) with a solvent having an affinity for aromatic hydrocarbons to obtain a raffinate and a solvent extract, said solvent extract having a total acid value of more than about 8,
   (3) neutralizing said extract with an alkali to form a neutralized extract having a total acid value of less than 2.0,
   (4) vacuum distilling a topped crude oil and collecting a distillate (ii) having a total acid value of greater than 2.0,
   (5) neutralizing said distillate (ii) with an alkali to form a neutralized distillate (ii) having a total acid value of less than 2.0,
   (6) forming a mixture of from 10 to 60 percent of said neutralized extract and from 90 to 40 percent of said neutralized distillate (ii), and
   (7) hydrofinishing said mixture formed in (6).

6. The method of claim 5 wherein said solvent extract which has been extracted from said distillate (i) has a total acid value of at least about 8.4.

7. The method of claim 1 wherein said solvent extract which has been extracted from said distillate (i) has a total acid value of at least about 8.4.

* * * * *